United States Patent [19]

Bazzle et al.

[11] 4,130,950

[45] Dec. 26, 1978

[54] SHOE INCLUDING GOLF BALL POSITION MARKER

[75] Inventors: Lillian M. Bazzle, Williamsburg; Marshall J. Staton, Hampton, both of Va.

[73] Assignee: Lillian Mae Bazzle, Wiliamsburg, Va.

[21] Appl. No.: 793,250

[22] Filed: May 3, 1977

Related U.S. Application Data

[63] Continuation of Ser. No. 683,486, May 5, 1976, abandoned.

[51] Int. Cl.[2] ..... A63B 57/00

[52] U.S. Cl. ..... 36/127; 273/32 A; 273/1 M; 36/132

[58] Field of Search ..... 273/32 A, DIG. 18, 1 M; 35/29; 36/127, 132, 136, 137, 139; 224/5 C

[56] References Cited

U.S. PATENT DOCUMENTS

| | | | |
|---|---|---|---|
| 262,594 | 8/1882 | How | 36/136 X |
| 922,499 | 5/1909 | Molitor | 36/136 X |
| 1,583,274 | 5/1926 | Bostock | 36/45 X |
| 2,178,872 | 11/1939 | Engstrom | 273/32 A |
| 2,722,062 | 11/1955 | Phillips | 36/127 X |
| 2,971,278 | 2/1961 | Scholl | 36/45 X |
| 3,233,802 | 2/1966 | Ludwick | 273/32 A X |
| 3,556,364 | 1/1971 | Maretka | 273/32 A |

*Primary Examiner*—George J. Marlo

*Attorney, Agent, or Firm*—Stanley C. Spooner; Thomas B. Van Poole

[57] ABSTRACT

A permanent magnet is fixably mounted on a typical golf shoe to retain a thin metal disc when placed thereon. The disc, which is brightly colored, may be removed from the magnet to mark the position of a golf ball on a putting green. The disc may then later be placed back on the magnet where it is retained for further use.

5 Claims, 2 Drawing Figures

SHOE INCLUDING GOLF BALL POSITION MARKER

This is a continuation of application Ser. No. 683,486, filed May 5, 1976, now abandoned.

BACKGROUND OF THE INVENTION

This invention relates to a ball position marker which is releasably retained on the person of a golfer when playing the game of golf.

As is generally known, in playing the game of golf, it is customary for a golfer lying furthest from the hole to shoot first. If there is a golf ball on the green which could interfere with the line of his shot, the ball is normally removed temporarily with its position denoted by a small relatively flat marker. Many players use pocket change or other thin flat objects to mark the position of the ball without interfering with the path of the ball to be shot first. Digging a dime or other suitable marker out of a pocket full of change, tees, and other golf paraphernalia is awkward and time-consuming at the least and almost impossible when wearing a golf glove. Most lady golfers do not have pockets in their clothing for conveniently storing such a marker. The solutions to this problem in the past have been the addition of snaps on either the golf glove or the handle of a golf club which frictionally engage a small marker. Difficulties arise in that the snap-on marker is typically small and can easily be lost if accidentally dropped. Furthermore, many lady golfers break their fingernails in attempting to remove a stuck snap-on marker. In the type which is snapped on to a club handle, the marker can be accidentally jarred loose when the club is replaced in the golf bag making it difficult if not impossible to find. A further solution is to mount a magnetically held marker on a belt buckle as in U.S. Pat. No. 3,208,123. Because most lady golfers do not wear belts, this solution is unavailable to them. Additionally, many of the slacks with elastic waistbands for men do not have belt loops creating the need for a further solution.

Accordingly, it is an object of the present invention to provide a golf ball position marker that is removably retained at a convenient location on a golf shoe.

It is a further object to provide a golf ball position marker which is easily removed by a person with long fingernails.

A still further object is a golf ball position marker which is retained on a golf shoe such that replacing the marker and the golf ball can be done with one move and in one position.

SUMMARY OF THE INVENTION

The foregoing and other objects are achieved by the mounting of a small permanent magnet on a golf shoe where it magnetically retains a thin, flat, metal position marker. When needed, the marker is removed from its position on the golf shoe, placed next to the golf ball and in the same motion the golf ball is removed from the green.

DETAILED DESCRIPTION OF A PREFERRED EMBODIMENT

Figure 1:
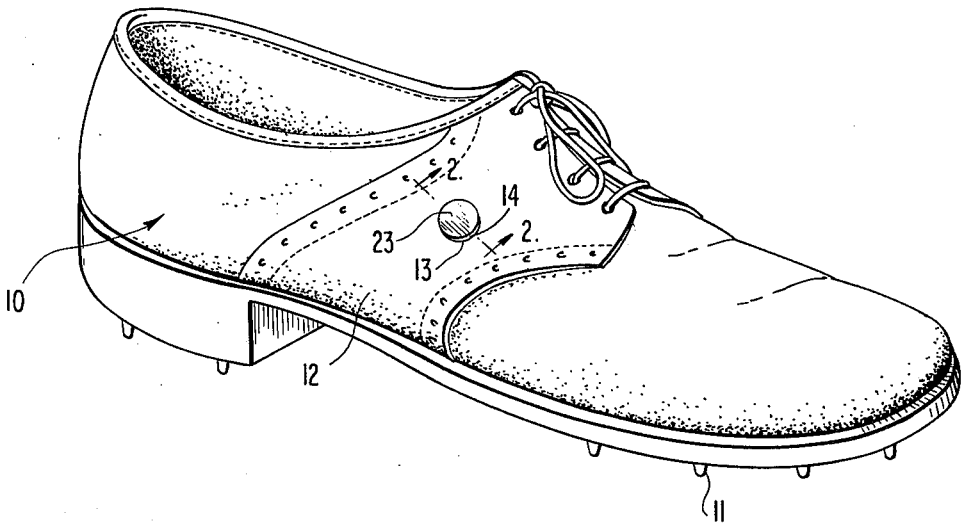
FIG. 1 is a perspective view of a typical golf shoe utilizing the present invention.

Referring now to the Figures where like reference numerals illustrate the same elements throughout the several views.

FIG. 1 depicts a typical golf shoe 10 which is used by a golfer in playing the game of golf. Spikes on the bottom of the shoe 11 insure a good stance and are a necessity for every serious golfer. The reinforcing section 12 has had a circular portion removed to form hole 13 into which permanent magnet 14 is fixably mounted. Although the magnet could be retained in any one of a number of fashions, in one embodiment a strong glue was used.

Figure 2:
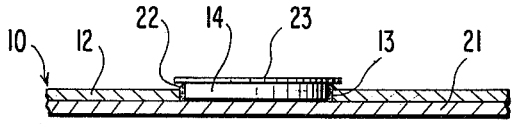
FIG. 2 is a cross-sectional view of the portion of the golf shoe in FIG. 1 containing the ball position marker.

In FIG. 2 the mounting arrangement of one embodiment of the applicant's invention is detailed. As in ordinary golf shoe construction, reinforcing section 12 is constructed over the base leather layer 21 from which shoe 10 has been constructed. A hole 13 is formed in reinforcing section 12 and permanent magnet 14 is secured therein through the use of glue 22. It can easily be seen then that when the thin metal disc marker 23 is placed on permanent magnet 14, it will be securely retained thereon until forceably removed.

As can be seen, the present invention requires that the marker 23 be slid sideways along the magnet until it can easily be grasped and removed eliminating the danger with the snap-on markers of broken or injured fingernails. Because most golfers will be wearing golf shoes, the marker is always readily accessible and thus the delays of the golf game and the frustration arising from lost or misplaced snap-on markers is eliminated. Furthermore, this marker is not easily lost since the golfer's hand is already close to the ground when the marker is removed. Use of this ball position marker eliminates the requirement of a cumbersome golf belt as well as accommodating those who prefer not to wear a golf glove as previously required to retain the ball position markers.

Although the invention has been described largely in terms of one specific embodiment, it should be understood that the invention is not so limited and many further embodiments will be clear to those of ordinary skill in the art without departing from the scope of the appended claims.

We claim:

1. In combination a shoe, golf ball position marker, and magnet support incorporated in the shoe for releasably magnetically retaining the ball position marker in supported relation on the shoe, said shoe having a sole and an upper extending above the shoe sole providing a foot receiving cavity, the shoe upper including a first base layer, and a second outer layer which is in direct engagement with said first base layer to reinforce the base layer at the instep of the shoe, said golf ball position marker being of magnetizable material capable of being attracted to and held by said magnet support, said magnet support being a magnet securely mounted in fixed relation in an opening in said second outer layer at a location overlying the outer side of the instep portion of the shoe for removably retaining the ball position marker by magnetic attraction forces and permitting said ball position marker to be removed from said shoe by sliding same sideways along said magnet to a position overlying said second outer layer whereby said marker may be easily grasped and removed in one single hand movement along the outer side of said shoe.

2. The combination defined in claim 1, wherein said ball position marker is a flat circular disk of magnetically attractable material, and said magnet member is a flat integral metallic body having a flat outer face carried closely adjacent the exterior surface of the shoe instep portion against which the marker disk is magnetically held substantially flush with the instep portion exterior surface.

3. The combination defined in claim 2, wherein said magnet member is a thin flat disk shaped magnet providing a round flat outer magnet face at the adjacent exterior surface of said instep position having generally the same diameter and shape as the ball position marker.

4. The combination defined in claim 1, wherein said ball position marker is a flat circular disk of ferromagnetic metal, and said magnet is a flat integral metallic body having a flat outer face carried closely adjacent the exterior surface of the shoe instep portion against which the marker disk is magnetically held substantially flush with the instep portion exterior surface.

5. The combination defined in claim 4, wherein said magnet member is a thin flat disk shaped magnet providing a round flat outer magnet face at the adjacent exterior surface of said instep position having generally the same diameter and shape as the ball position marker.

* * * * *